United States Patent [19]

Tamura et al.

[11] Patent Number: 5,047,176

[45] Date of Patent: Sep. 10, 1991

[54] INCOMBUSTIBLE AZEOTROPIC LIKE SOLVENT COMPOSITIONS

[75] Inventors: Kohji Tamura, Kawanishi; Yukio Omure, Takatsuki; Satoshi Ide, Osaka; Naoyoshi Hanatani; Toshimasa Fukuzawa, both of Settsu, all of Japan

[73] Assignee: Daikin Industries, Ltd., Osaka, Japan

[21] Appl. No.: 288,897

[22] Filed: Dec. 23, 1988

[30] Foreign Application Priority Data

Dec. 26, 1987 [JP] Japan ..... 62-330892

[51] Int. Cl.[5] ..... C11D 7/50; B01F 1/00

[52] U.S. Cl. ..... 252/364; 252/DIG. 9; 252/172

[58] Field of Search ..... 252/364, DIG. 9, 172

[56] References Cited

U.S. PATENT DOCUMENTS

| | | | |
|---|---|---|---|
| 3,607,767 | 9/1971 | Schofield | 252/364 X |
| 4,055,507 | 10/1977 | Dastur et al. . | |
| 4,279,664 | 7/1981 | Figiel et al. | 252/364 X |
| 4,279,665 | 7/1981 | Colbert et al. | 252/364 X |
| 4,476,036 | 10/1984 | Figiel et al. | 252/364 X |
| 4,584,122 | 4/1986 | Basu et al. | 252/364 X |
| 4,606,841 | 8/1986 | Basu et al. | 252/364 X |
| 4,808,331 | 2/1989 | Burt et al. | 252/172 |

FOREIGN PATENT DOCUMENTS

| | | |
|---|---|---|
| 0183109 | 8/1985 | European Pat. Off. . |
| 0160854 | 12/1985 | European Pat. Off. . |
| 0217181 | 8/1986 | European Pat. Off. . |

OTHER PUBLICATIONS

Chemical Abstracts, vol. 95, No. 12, Sep. 1981, p. 102, Abstract No. 99709j, Columbus, Ohio, U.S.. & JP-A-81 34 798 (Daikin Kogyo Co., Ltd. 07-04-1981).

*Primary Examiner*—Edward A. Miller

*Attorney, Agent, or Firm*—Armstrong, Nikaido, Marmelstein, Kubovcik & Murray

[57] ABSTRACT

Incombustible azeotropic like solvent compositions comprising 87 to 92 parts by weight of 1,1,2-trichloro-1,2,2-trifluoroethane and 8 to 13 parts by weight of hydrocarbons, said hydrocarbons have a boiling point of 49° to 58° C.

1 Claim, 1 Drawing Sheet

INCOMBUSTIBLE AZEOTROPIC LIKE SOLVENT COMPOSITIONS

BACKGROUND OF THE INVENTION

The present invention relates to incombustible azeotropic like solvent compositions comprising 1,1,2-trichloro-1,2,2-trifluoroethane (hereinafter referred to as "Flon-113") and hydrocarbons.

Hitherto, Flon-113 which is a chlorofluoroethane compound is used alone or in a mixture or azeotropic mixture with other organic solvents as washing or cleaning liquids or solvents, because of their various advantages such as incombustibility, low toxicity and selective solubility that they can dissolve fats, greases, waxes and the like without erosion of high molecular compounds such as rubbers and plastics.

Recently, with advance in electronic parts such as semiconductors, it is important to wash out and remove waxes which are used for temporary fixing in preparation steps of such electronic parts. For washing out the waxes, trichloroethylene and 1,1,1-trichloroethane are generally used, but there are troubles that they pollute atomosphere and underground water because of their high toxicity.

On the other hand, hydrocarbons are not suitable for use of cleaning because of their combustibility. Also, though there are known mixtures with Flon-113, the mixtures are not easy to handle due to their instability, because, for example, when they are used repeatedly in vapor washing method, the mixtures change in the proportion of components to be combustible even if the starting mixtures are incombustible.

SUMMARY OF THE INVENTION

According to the present invention, there can be provided azeotropic like solvent compositions which can dissolve waxes more than Flon-113 and are stable in an incombustible range. The compositions of the present invention comprise 87 to 92 parts (parts by weight, hereinafter the same) of Flon-113 and 8 to 13 parts of hydrocarbons, and the hydrocarbons have a boiling point of 49° to 58° C.

DETAILED DESCRIPTION OF THE INVENTION

Figure 1:
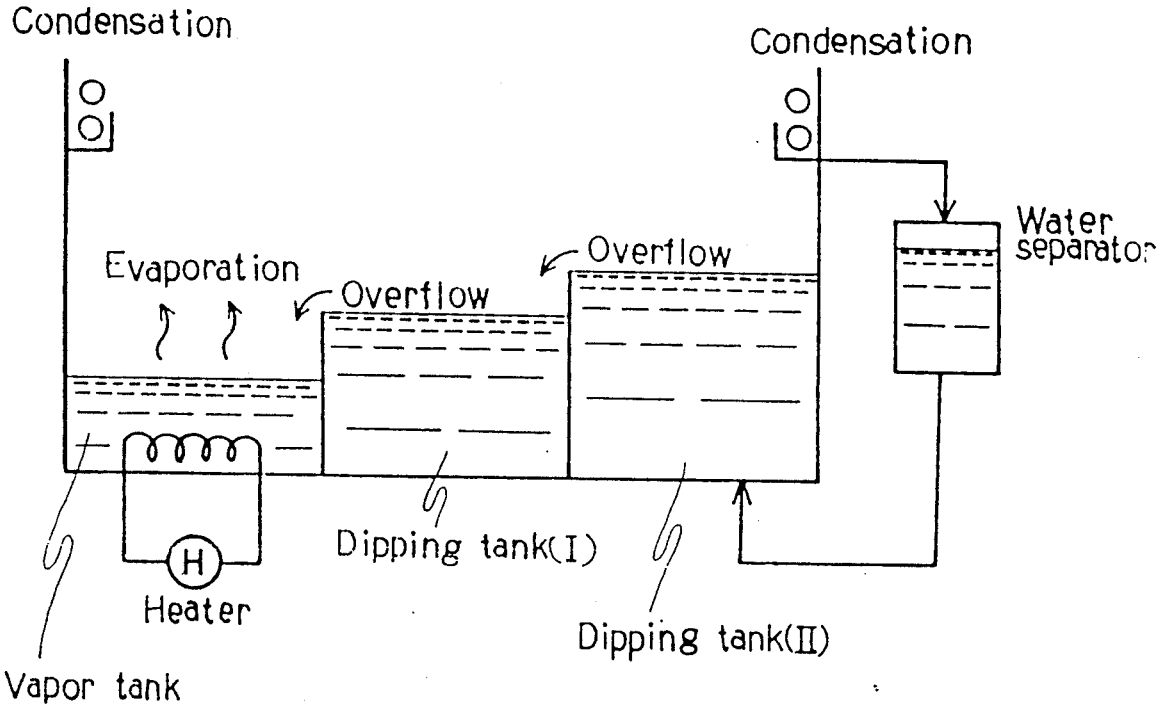
FIG. 1 is a diagramatic view of the three-tank-cleaning machine used in Example 5.

The most characteristic matter of the present invention is to select the particular hydrocarbons having the narrow range of boiling point, i.e. 49° to 58° C. for mixing with Flon-113, and to admix Flon-113 and the particular hydrocarbons at a weight ratio of 87-92/13-8. A composition lacking the particular characteristic matters cannot be used stably, because the composition changes in proportion of components to become combustible when the composition is repeatedly used.

The above-mentioned effects can be improved, when two or more kinds of hydrocarbons are used as the hydrocarbons.

As the hydrocarbon mixture, there is preferably employed a mixture which contains cyclopentane (b.p. 49° C.) and 2-methylpentane (b.p. 60° C.), particularly not less than 50% (% by weight, hereinafter the same), preferably 60to 70% of cyclopentane, and not less than 5%, preferably 20 to 30% of -methylpentane in view of minor change of composition. These hydrocarbons can be obtained, for example, as petroleum distilates, and may contain other remaining hydrocarbons such as 3-methylpentane, 2,2-dimethylbutane, 2,3-dimethylbutane, methylcyclopentane and n-hexane, up to 10%.

However, when a boiling point of the hydrocarbons is higher than 58° C., a proportion of the hydrocarbons in liquid state becomes greater so that the composition becomes combustible, and when lower than 49° C., a proportion of hydrocarbons in gaseous state becomes greater so that the composition becomes also combustible.

The mixing ratio of the hydrocarbons and Flon-113 is 8 to 13/87 to 92 in order to obtain a stable composition in an incombustible region. Namely when hydrocarbons are mixed in a greater amount than the above ratio, even if a boiling point of the hydrocarbons is within the above range, a proportion of the hydrocarbons in the gaseous composition becomes large by repeated use, and, as the result, the solvent composition becomes combustible. On the other hand, when a solvent composition contains a smaller amount of hydrocarbons, a proportion of the hydrocarbons is not stable in repeated use, and also a solubility of stain materials becomes low.

The solvent composition of the present invention having the above mixing ratio and boiling point range shows an azeotropic like state, i.e. less proportion change. The solvent composition has a boiling point of about 45° to 48° C. and is incombustible.

Since the solvent composition can maintain an azeotropic like state and is incombustible, the composition is not only used in safety and is easy to control the particular proportion of liquid and to recover and recycle the solvent composition. Therefore the solvent composition can be applied to a recycle cleaning system or a vapor cleaning system.

The solvent composition has an increased solubility power to waxes due to the mixing of a small amount (8 to 13%) of the hydrocarbons. Also according to the present invention, bad influences of the hydrocarbons, i.e. erosion of rubbers and plastics can be reduced, and thus articles to be cleaned can be washed whole. In addition, there is an advantage that an amount of Flon-113 which is one of perhaloethanes that may destroy the ozone layer can be decreased.

Though the solvent composition of the present invention is chemically stable, stabilizers may be added to the composition.

It is preferred that the stabilizers can be distilled together with the composition, more desirably can form an azeotropic system, in addition that the stabilizers have a large stabilizing effect against the composition.

Examples of the stabilizers are, for instance, aliphatic nitro compounds such as nitromethane, nitroethane and nitropropane; acetylene alcohols such as 3-methyl-1-butyne-3-ol and 3-methyl-1-pentyne-3-ol; epoxides such as glycidol, methyl glycidyl ether, allyl glycidyl ether, phenyl glycidyl ether, 1,2-butylene oxide, cyclohexene oxide and epichlorohydrin; ethers such as dimethoxymethane, 1,2-dimethoxyethane,1,4-dioxane and 1,3,5-trioxane; unsaturated hydrocarbons such as hexene, heptene, octene, 2,4,4-trimethyl-1-pentene, pentadiene, octadiene, cyclohexene and cyclopentene; olefinic alcohols such as allyl alcohol, 1-butene-3-ol and 3-methyl-1-butene-3-ol; acrylates such as methyl acrylate, ethyl acrylate and butyl acrylate; and the like. These stabilizers can be used alone or in an admixture. In addition, other compounds may be used together with the above stabilizers. In such case synergistic stabilizing effects can be obtained. Examples of the other compounds are, for instance, phenols such as phenol, trimethylphenol, cyclohexylphenol, thymol, 2,6-di-t-butyl-4-methylphenol, butylhydroxyanisole and isoeugenol; amines such as hexylamine, pentylamine, dipropylamine, diisopropylamine, diisobutylamine, triethylamine, tributylamine, pyridine, N-methylmorpholine, cyclohexylamine, 2,2,6,6-tetramethylpyridine and N,N'-diallyl-p-phenylenediamine; triazoles such as benzotriazole, 2-(2'-hydroxy5'-methylphenyl)benzotriazole and chlorobenzotriazole; and the like.

Amount of the stabilizers varies on kinds of the stabilizers, and is generally 0.1 to 10%, preferably 0.5 to 5% to the composition.

The composition of the present invention is useful as a cleaning solvent for fats or greases and temporary fixing waxes used in cutting or polishing steps of silicon wafers for semiconductors, quartz or ceramics.

The present invention is more specifically described and explained by means of the following Examples. It is to be understood that the present invention is not limited to the Examples and various changes and modifications may be made in the invention without departing from the spirit and scope thereof.

Example 1

Flon-113 and the following hydrocarbon mixture (b.p. 54° to 57° C.) were admixed in a weight ratio of 90/10 to obtain the solvent composition (b.p. 46.5° to 47.5° C.). This composition was incombustible.

| Hydrocarbon mixture | |
|---|---|
| (Components) | (% by weight) |
| Cyclopentane | 65 |
| 2-Methylpentane | 35 |

EXAMPLE 2

Flon-113 and the following hydrocarbon mixture (b.p. 54° to 58° C.) were admixed in a weight ratio of 90/10 to obtain the solvent composition (b.p. 46.7° to 47.7° C.). This composition was incombustible.

| Hydrocarbon mixture | |
|---|---|
| (Components) | (% by weight) |
| Cyclopentane | 65 |
| 2-Methylpentane | 24 |
| 2,3-Dimethylbutane | 5 |
| 3-Methylpentane | 5 |
| 2,2-Dimethylbutane | 1 |

EXAMPLE 3

Flon-113 and the following hydrocarbon mixture (b.p. 49° to 52° C.) were admixed in a weight ratio of 90/10 to obtain the solvent composition (b.p. 46.0° to 47.0° C.). This composition was incombustible.

| Hydrocarbon mixture | |
|---|---|
| (Components) | (% by weight) |
| Cyclopentane | 89 |
| 2-Methylpentane | 10 |

-continued

| Hydrocarbon mixture | |
|---|---|
| (Components) | (% by weight) |
| n-Hexane | 1 |

EXAMPLE 4

Flon-113 and the following hydrocarbon mixture (b.p. 45.20 to 58° C.) were admixed in a weight ratio of 87/13 to obtain the solvent composition (b.p. 47.0° to 48.0° C.). This composition was incombustible.

| Hydrocarbon mixture | |
|---|---|
| (Components) | (% by weight) |
| Cyclopentane | 65 |
| 2-Methylpentane | 24 |
| 2,3-Dimethylbutane | 5 |
| 3-Methylpentane | 5 |
| 2,2-Dimethylbutane | 1 |

COMPARATIVE EXAMPLE 1

Flon-113 and the following hydrocarbon mixture (b.p. 49° to 52° C.) were admixed in a weight ratio of 85/15 to obtain a comparative solvent composition. This composition was incombustible.

| Hydrocarbon mixture | |
|---|---|
| (Components) | (% by weight) |
| Cyclopentane | 88 |
| 2-Methylpentane | 10 |
| n-Hexane | 2 |

COMPARATIVE EXAMPLE 2

Flon-113 and the following hydrocarbon mixture (b.p. 54° to 58° C.) were admixed in a weight ratio of 85/15 to obtain a comparative solvent composition. This composition was incombustible.

| Hydrocarbon mixture | |
|---|---|
| (Components) | (% by weight) |
| Cyclopentane | 65 |
| 2-Methylpentane | 24 |
| 2,3-Dimethylbutane | 5 |
| 3-Methylpentane | 5 |
| 2,2-Dimethylbutane | 1 |

COMPARATIVE EXAMPLE 3

Flon-113 and the following hydrocarbon mixture (b.p. 59° to 62° C.) were admixed in a weight ratio of 90/10 to obtain a comparative solvent composition. This composition was incombustible.

| Hydrocarbon mixture | |
|---|---|
| (Components) | (% by weight) |
| Cyclopentane | 4 |
| 2-Methylpentane | 67 |
| 2,3-Dimethylbutane | 7 |
| 3-Methylpentane | 20 |
| 2,2-Dimethylbutane | 2 |

COMPARATIVE EXAMPLE 4

Flon-113 and the following hydrocarbon mixture (b.p. 54° to 58° C.) were admixed in a weight ratio of 95/5 to obtain a comparative solvent composition. This composition was incombustible.

| Hydrocarbon mixture (Components) | (% by weight) |
|---|---|
| Cyclopentane | 65 |
| 2-Methylpentane | 24 |
| 2,3-Dimethylbutane | 5 |
| 3-Methylpentane | 5 |
| 2,2-Dimethylbutane | 1 |

COMPARATIVE EXAMPLE 5

Flon-113 and the following hydrocarbon mixture (b.p. 41° to 44° C.) were admixed in a weight ratio of 90/10 to obtain a comparative solvent composition. This composition was incombustible.

| Hydrocarbon mixture (Components) | (% by weight) |
|---|---|
| Cyclopentane | 50 |
| n-Pentane | 50 |

EXAMPLE 5

The change in a proportion of the components of the solvent compositions prepared in Examples 1 to 4 and Comparative Examples 1 to 5 was measured by the following method. The results are shown in Tables 1 to 9.

The method is carried out by using a three-tank-cleaning machine shown in FIG. 1 according to the cleaning cycle:

Vapor tank $\xrightarrow[\text{Condense}]{\text{Evaporate}}$ Water separator $\longrightarrow$ Dipping tank(II) $\xrightarrow{\text{Overflow}}$ Dipping tank(I) $\xrightarrow{\text{Overflow}}$ Vapor tank.

The solvent composition to be tested is cycled for 3 days (8 hours per day). The proportions of the components in the vapor tank and the dipping tank(II) are measured, respectively. The measurement is conducted 8 hours after (1 day after), 16 hours after (2 days after) and 24 hours after (3 days after).

TABLE 1

(Example 1)

| Tank | Components | Proportion of the components (% by weight) Initial | 1 day after | 2 days after | 3 days after |
|---|---|---|---|---|---|
| Vapor tank | Flon-113 | 90.0 | 90.0 | 90.0 | 90.2 |
| | Hydrocarbon mixture | 10.0 | 10.0 | 10.0 | 9.8 |
| | Cyclopentane | 6.5 | 6.4 | 6.4 | 6.3 |
| | 2-Methylpentane | 3.5 | 3.6 | 3.6 | 3.5 |
| | 2,3-Dimethylbutane | — | — | — | — |
| | 3-Methylpentane | — | — | — | — |
| | 2,2-dimethylbutane | — | — | — | — |
| | n-Hexane | — | — | — | — |
| | Combustibility | None | None | None | None |

TABLE 1-continued (Example 1)

| Tank | Components | Proportion of the components (% by weight) Initial | 1 day after | 2 days after | 3 days after |
|---|---|---|---|---|---|
| Dipping tank (II) | Flon-113 | 90.0 | 90.0 | 89.9 | 90.0 |
| | Hydrocarbon mixture | 10.0 | 10.0 | 10.1 | 10.0 |
| | Cyclopentane | 6.5 | 6.6 | 6.7 | 6.7 |
| | 2-Methylpentane | 3.5 | 3.4 | 3.4 | 3.3 |
| | 2,3-Dimethylbutane | — | — | — | — |
| | 3-Methylpentane | — | — | — | — |
| | 2,2-Dimethylbutane | — | — | — | — |
| | n-Hexane | — | — | — | — |
| | Combustibility | None | None | None | None |

TABLE 2

(Example 2)

| Tank | Components | Proportion of the components (% by weight) Initial | 1 day after | 2 days after | 3 days after |
|---|---|---|---|---|---|
| Vapor tank | Flon-113 | 90.0 | 90.0 | 90.1 | 90.2 |
| | Hydrocarbon mixture | 10.0 | 10.0 | 9.9 | 9.8 |
| | Cyclopentane | 6.5 | 6.4 | 6.3 | 6.3 |
| | 2-Methylpentane | 2.4 | 2.5 | 2.5 | 2.4 |
| | 2,3-Dimethylbutane | 0.5 | 0.5 | 0.5 | 0.5 |
| | 3-Methylpentane | 0.5 | 0.5 | 0.5 | 0.5 |
| | 2,2-dimethylbutane | 0.1 | 0.1 | 0.1 | 0.1 |
| | n-Hexane | — | — | — | — |
| | Combustibility | None | None | None | None |
| Dipping tank (II) | Flon-113 | 90.0 | 90.1 | 90.0 | 90.0 |
| | Hydrocarbon mixture | 10.0 | 9.9 | 10.0 | 10.0 |
| | Cyclopentane | 6.5 | 6.6 | 6.7 | 6.7 |
| | 2-Methylpentane | 2.4 | 2.3 | 2.3 | 2.3 |
| | 2,3-Dimethylbutane | 0.5 | 0.5 | 0.5 | 0.5 |
| | 3-Methylpentane | 0.5 | 0.4 | 0.4 | 0.4 |
| | 2,2-Dimethylbutane | 0.1 | 0.1 | 0.1 | 0.1 |
| | n-Hexane | — | — | — | — |
| | Combustibility | None | None | None | None |

TABLE 3

(Example 3)

| Tank | Components | Proportion of the components (% by weight) Initial | 1 day after | 2 days after | 3 days after |
|---|---|---|---|---|---|
| Vapor tank | Flon-113 | 90.0 | 92.0 | 92.5 | 92.6 |
| | Hydrocarbon mixture | 10.0 | 8.0 | 7.5 | 7.4 |
| | Cyclopentane | 8.9 | 6.8 | 6.3 | 6.2 |
| | 2-Methylpentane | 1.0 | 1.0 | 1.0 | 1.0 |
| | 2,3-Dimethylbutane | — | — | — | — |
| | 3-Methylpentane | — | — | — | — |
| | 2,2-dimethylbutane | — | — | — | — |
| | n-Hexane | 0.1 | 0.2 | 0.2 | 0.2 |
| | Combustibility | None | None | None | None |
| Dipping tank (II) | Flon-113 | 90.0 | 89.0 | 88.8 | 88.7 |
| | Hydrocarbon mixture | 10.0 | 11.0 | 11.2 | 11.3 |
| | Cyclopentane | 8.9 | 9.9 | 10.1 | 10.2 |
| | 2-Methylpentane | 1.0 | 1.1 | 1.1 | 1.1 |
| | 2,3-Dimethylbutane | — | — | — | — |
| | 3-Methylpentane | — | — | — | — |
| | 2,2-Dimethylbutane | — | — | — | — |
| | n-Hexane | 0.1 | — | — | — |
| | Combustibility | None | None | None | None |

TABLE 4

(Example 4)

| Tank | Components | Proportion of the components (% by weight) Initial | 1 day after | 2 days after | 3 days after |
|---|---|---|---|---|---|
| Vapor tank | Flon-113 | 87.0 | 87.8 | 88.1 | 88.2 |
| | Hydrocarbon mixture | 13.0 | 12.2 | 11.9 | 11.8 |
| | Cyclopentane | 8.6 | 7.4 | 7.0 | 6.7 |
| | 2-Methylpentane | 3.1 | 3.4 | 3.5 | 3.6 |
| | 2,3-Dimethylbutane | 0.6 | 0.6 | 0.6 | 0.6 |
| | 3-Methylpentane | 0.6 | 0.7 | 0.7 | 0.8 |
| | 2,2-dimethylbutane | 0.1 | 0.1 | 0.1 | 0.1 |
| | n-Hexane | — | — | — | — |
| | Combustibility | None | None | None | None |
| Dipping tank (II) | Flon-113 | 87.0 | 86.5 | 86.3 | 90.0 |
| | Hydrocarbon mixture | 13.0 | 13.5 | 13.7 | 10.0 |
| | Cyclopentane | 8.6 | 9.3 | 9.5 | 86.3 |
| | 2-Methylpentane | 3.1 | 3.0 | 3.0 | 2.9 |
| | 2,3-Dimethylbutane | 0.6 | 0.6 | 0.6 | 0.6 |
| | 3-Methylpentane | 0.6 | 0.5 | 0.5 | 0.4 |
| | 2,2-Dimethylbutane | 0.1 | 0.1 | 0.1 | 0.1 |
| | n-Hexane | — | — | — | — |
| | Combustibility | None | None | None | None |

TABLE 5

(Comparative Example 1)

| Tank | Components | Proportion of the components (% by weight) Initial | 1 day after | 2 days after | 3 days after |
|---|---|---|---|---|---|
| Vapor tank | Flon-113 | 85.0 | 88.2 | 89.7 | 89.8 |
| | Hydrocarbon mixture | 15.0 | 11.2 | 10.3 | 10.2 |
| | Cyclopentane | 13.3 | 8.9 | 7.8 | 7.7 |
| | 2-Methylpentane | 1.5 | 1.8 | 2.0 | 2.0 |
| | 2,3-Dimethylbutane | — | — | — | — |
| | 3-Methylpentane | — | — | — | — |
| | 2,2-dimethylbutane | — | — | — | — |
| | n-Hexane | 0.2 | 0.5 | 0.5 | 0.5 |
| | Combustibility | None | None | None | None |
| Dipping tank (II) | Flon-113 | 85.0 | 83.2 | 82.8 | 82.7 |
| | Hydrocarbon mixture | 15.0 | 16.8 | 17.2 | 17.3 |
| | Cyclopentane | 13.3 | 15.5 | 16.0 | 16.1 |
| | 2-Methylpentane | 1.5 | 1.3 | 1.2 | 1.2 |
| | 2,3-Dimethylbutane | — | — | — | — |
| | 3-Methylpentane | — | — | — | — |
| | 2,2-Dimethylbutane | — | — | — | — |
| | n-Hexane | 0.2 | — | — | — |
| | Combustibility | None | Combustible | Combustible | Combustible |

TABLE 6

(Comparative Example 2)

| Tank | Components | Proportion of the components (% by weight) Initial | 1 day after | 2 days after | 3 days after |
|---|---|---|---|---|---|
| Vapor tank | Flon-113 | 85.0 | 85.7 | 86.7 | 88.1 |
| | Hydrocarbon mixture | 15.0 | 14.3 | 13.3 | 11.9 |
| | Cyclopentane | 9.8 | 7.1 | 5.6 | 4.0 |
| | 2-Methylpentane | 3.6 | 4.9 | 4.9 | 5.0 |
| | 2,3-Dimethylbutane | 0.7 | 1.1 | 1.3 | 1.4 |
| | 3-Methylpentane | 0.7 | 1.1 | 1.4 | 1.4 |
| | 2,2-dimethylbutane | 0.2 | 0.1 | 0.1 | 0.1 |
| | n-Hexane | — | — | — | — |
| | Combustibility | None | None | None | None |
| Dipping tank (II) | Flon-113 | 85.0 | 83.9 | 83.4 | 83.2 |
| | Hydrocarbon mixture | 15.0 | 16.1 | 16.6 | 16.8 |
| | Cyclopentane | 9.8 | 11.7 | 12.8 | 13.4 |

TABLE 6-continued (Comparative Example 2)

| Tank | Components | Proportion of the components (% by weight) Initial | 1 day after | 2 days after | 3 days after |
|---|---|---|---|---|---|
| | 2-Methylpentane | 3.6 | 3.0 | 2.6 | 2.5 |
| | 2,3-Dimethylbutane | 0.7 | 0.6 | 0.5 | 0.4 |
| | 3-Methylpentane | 0.7 | 0.6 | 0.5 | 0.3 |
| | 2,2-Dimethylbutane | 0.2 | 0.2 | 0.2 | 0.2 |
| | n-Hexane | — | — | — | — |
| | Combustibility | None | Combustible | Combustible | Combustible |

TABLE 7

(Comparative Example 3)

| Tank | Components | Proportion of the components (% by weight) Initial | 1 day after | 2 days after | 3 days after |
|---|---|---|---|---|---|
| Vapor tank | Flon-113 | 90.0 | 81.8 | 80.0 | 78.9 |
| | Hydrocarbon mixture | 10.0 | 18.2 | 20.0 | 21.1 |
| | Cyclopentane | 0.5 | 0.1 | 0.1 | 0.1 |
| | 2-Methylpentane | 6.7 | 13.0 | 14.1 | 15.1 |
| | 2,3-Dimethylbutane | 0.7 | 1.3 | 1.5 | 1.6 |
| | 3-Methylpentane | 2.0 | 3.5 | 4.0 | 4.1 |
| | 2,2-dimethylbutane | — | — | — | — |
| | n-Hexane | 0.1 | 0.3 | 0.3 | 0.3 |
| | Combustibility | None | Combustible | Combustible | Combustible |
| Dipping tank (II) | Flon-113 | 90.0 | 93.7 | 94.7 | 90.0 |
| | Hydrocarbon mixture | 10.0 | 6.3 | 5.3 | 5.0 |
| | Cyclopentane | 0.5 | 0.9 | 1.0 | 1.0 |
| | 2-Methylpentane | 6.7 | 3.7 | 3.0 | 2.8 |
| | 2,3-Dimethylbutane | 0.7 | 0.4 | 0.3 | 0.3 |
| | 3-Methylpentane | 2.0 | 1.3 | 1.0 | 0.4 |
| | 2,2-Dimethylbutane | — | — | — | — |
| | n-Hexane | 0.1 | — | — | — |
| | Combustibility | None | None | None | None |

TABLE 8

(Comparative Example 4)

| Tank | Components | Proportion of the components (% by weight) Initial | 1 day after | 2 days after | 3 days after |
|---|---|---|---|---|---|
| Vapor tank | Flon-113 | 95.0 | 96.3 | 96.1 | 96.2 |
| | Hydrocarbon mixture | 5.0 | 3.7 | 3.9 | 3.8 |
| | Cyclopentane | 3.1 | 1.2 | 1.1 | 1.0 |
| | 2-Methylpentane | 1.2 | 1.5 | 1.6 | 1.6 |
| | 2,3-Dimethylbutane | 0.3 | 0.5 | 0.6 | 0.6 |
| | 3-Methylpentane | 0.3 | 0.5 | 0.6 | 0.6 |
| | 2,2-dimethylbutane | 0.1 | — | — | — |
| | n-Hexane | — | — | — | — |
| | Combustibility | None | None | None | None |
| Dipping tank (II) | Flon-113 | 95.0 | 94.1 | 93.7 | 93.5 |
| | Hydrocarbon mixture | 5.0 | 5.9 | 6.3 | 6.5 |
| | Cyclopentane | 3.1 | 4.5 | 5.0 | 5.2 |
| | 2-Methylpentane | 1.2 | 1.0 | 0.9 | 0.4 |
| | 2,3-Dimethylbutane | 0.3 | 0.1 | 0.1 | 0.1 |
| | 3-Methylpentane | 0.3 | 0.1 | 0.1 | 0.1 |
| | 2,2-Dimethylbutane | 0.1 | 0.2 | 0.2 | 0.2 |
| | n-Hexane | — | — | — | — |
| | Combustibility | None | None | None | None |

TABLE 9

(Comparative Example 5)

| Tank | Components | Proportion of the components (% by weight) Initial | 1 day after | 2 days after | 3 days after |
|---|---|---|---|---|---|
| Vapor tank | Flon-113 | 90.0 | 96.5 | 97.5 | 97.8 |
| | Hydrocarbon mixture | 10.0 | 3.5 | 2.4 | 2.2 |
| | Cyclopentane | 5.0 | 3.0 | 2.0 | 1.8 |
| | n-Pentane | 5.0 | 0.5 | 0.4 | 0.4 |
| | Combustibility | None | None | None | None |
| Dipping tank (II) | Flon-113 | 90.0 | 86.6 | 86.0 | 85.9 |
| | Hydrocarbon mixture | 10.0 | 13.4 | 14.0 | 14.1 |
| | Cyclopentane | 5.0 | 6.0 | 6.5 | 6.6 |
| | n-Pentane | 5.0 | 7.4 | 7.5 | 7.5 |
| | Combustibility | None | Combustible | Combustible | Combustible |

EXAMPLE 6

A beaker of 200 cc was charged with 100 g of the solvent shown in Table 10. To the solvent was dividedly added four kinds of powdered paraffin waxes (m.p. 52° to 65° C., available from Nippon Seiro Co., Ltd.), and a solubility was evaluated.

The results are shown in Table 10.

The evaluation of the solubility is as follows:

◎: Soluble at a wax concentration of 2% or more

◎Soluble at a wax concentration of 1 to 2%

Δ: Partially soluble

X: Insoluble

EXAMPLE 7

With respect to the solvents shown in Table 10, influences (swelling) to various substrates (plastics) were measured according to the following method.

A glass autoclave of 100 cc was charged with 100 g of the solvent shown in Table 10 and a plastic test piece (5×50×2 mm). After allowing to stand in a thermostatic bath (50° C.) for 4 hours, the change of weight and volume of the test piece were rapidly measured. The results are shown in Table 10.

Evaluation in Table 10 is as follows:

◎: Increased weight or volume being 0 to 1%

○: Increased weight or volume being 1 to 3%

Δ: Increased weight or volume being 3 to 5%

X: Increased weight or volume being 5% or more.

TABLE 10

| Solvent | Solubility of Paraffin Waxes, Melting point of Waxes 52° C. | 57° C. | 60° C. | 65° C. | Influences to Substrates: Vinylchloride resin | ABS resin | Polypropylene | Acrylic resin |
|---|---|---|---|---|---|---|---|---|
| Ex. 1 | ◎ | ◎ | ○ | Δ | ◎ | ◎ | ○ | ◎ |
| Ex. 2 | ◎ | ◎ | ○ | Δ | ◎ | ◎ | ○ | ◎ |
| Ex. 3 | ◎ | ◎ | ○ | Δ | ◎ | ◎ | ○ | ◎ |
| Ex. 4 | ◎ | ◎ | ○ | Δ | ◎ | ◎ | ○ | ◎ |
| Flon-113 | ○ | Δ | x | x | ◎ | ◎ | ◎ | ◎ |
| Hydrocarbons in Ex. 1 | ◎ | ◎ | ○ | Δ | ○ | Δ | Δ | Δ |
| Hydrocarbons in Ex. 2 | ◎ | ◎ | ○ | Δ | ○ | Δ | Δ | Δ |
| Hydrocarbons in Ex. 3 | ◎ | ◎ | ○ | Δ | ○ | Δ | Δ | Δ |
| Hydrocarbons in Ex. 4 | ◎ | ◎ | ○ | Δ | ○ | Δ | Δ | Δ |

What we claim is:

1. A solvent composition consisting essentially of 87 to 92 parts by weight of 1, 1, 2-trichloro- 1, 2, 2-trifluoroethane and 8 to 13 parts by weight of a hydrocarbon mixture, the hydrocarbon mixture contains cyclopentane in an amount of not less than 50% by weight and 2-methylpentane in an amount of not less than 5% by weight, the solvent composition is incombustible and exhibits azeotropic-like properties and the boiling point range of the solvent composition is between 45°-48° C.

* * * * *